US006059474A

United States Patent [19]

Huang

[11] Patent Number: 6,059,474

[45] Date of Patent: May 9, 2000

[54] MULTI-PURPOSE NAIL ENAMEL APPLICATOR

[76] Inventor: Yu-Tsen Huang, No. 266, Hu-Shan St. Hua-Tan Hsiang, Chang Hua Hsien, Taiwan

[21] Appl. No.: 09/264,919

[22] Filed: Mar. 9, 1999

[51] Int. Cl.[7] ..... A45D 34/04

[52] U.S. Cl. ..... 401/129; 401/16; 401/26; 401/36; 132/73.5; 132/74.5; 132/75

[58] Field of Search ..... 401/16, 26, 27, 401/36, 38, 126, 129; 132/73.5, 74.5, 75

[56] References Cited

U.S. PATENT DOCUMENTS

| | | | |
|---|---|---|---|
| 2,869,162 | 1/1959 | Dritz | 401/26 |
| 3,341,884 | 9/1967 | Pryor | 132/74.5 |
| 5,762,077 | 1/1959 | Griffiths, Jr. | 132/74.5 |
| 5,913,630 | 6/1999 | Kelders et al. | 401/26 |

FOREIGN PATENT DOCUMENTS

| | | | |
|---|---|---|---|
| 95/20497 | 3/1995 | WIPO | 401/36 |

*Primary Examiner*—Charles R. Eloshway

[57] ABSTRACT

A nail enamel applicator includes a resilient tube with an open end for receiving nail enamel, a hollow adaptor, a hollow pen head and a brush member. The adaptor has opposed first and second ends. The first end of the adaptor is connected detachably to the open end of the resilient tube. The pen head is received in the adaptor and has an open first end and a second end with a hollow tip portion that extends outwardly through the second end of the adaptor. The brush member has a rod with first and second end portions. The first end portion of the rod extends into the resilient tube and has bristles connected thereto. The second end of the rod is connected to the first end of the adaptor and is inserted into the first end of the pen head. The second end of the rod has at least one passage formed therein in order to communicate fluidly the resilient tube and the pen head.

6 Claims, 8 Drawing Sheets

MULTI-PURPOSE NAIL ENAMEL APPLICATOR

BACKGROUND OF THE INVENTION

1. Field of the Invention

This invention relates to a nail enamel applicator, more particularly to a multi-purpose nail enamel applicator.

2. Description of the Related Art

Referring to FIG. 1, a conventional nail enamel applicator is shown to comprise a bottle 1 for receiving nail enamel, a cap member 3 and a brush member 2 connected to the cap member 3. The cap member 3 has an internal thread 301 that is connectable to an external thread 102 on an open end 101 of the bottle 1 to close the open end 101. In use, the cap member 3 is rotated for removal from the open end 101 of the bottle 1. Then, the nail enamel 4 is brushed onto the user's nails by means of the bristles 201 on the brush member 2 that have the nail enamel 4 attached thereto. Such a conventional nail enamel applicator can only be used to apply the nail enamel onto the nails by means of brushing.

SUMMARY OF THE INVENTION

The object of the present invention is to provide a nail enamel applicator that can be used to apply nail enamel onto nails in a manner not limited to brushing.

According to the present invention, the nail enamel applicator comprises a resilient tube with an open end for receiving nail enamel, a hollow adaptor, a hollow pen head and a brush member. The adaptor has opposed first and second ends. The first end of the adaptor is connected detachably to the open end of the resilient tube. The pen head is received in the adaptor and has an open first end and a second end with a hollow tip portion that extends outwardly through the second end of the adaptor. The brush member has a rod with first and second ends portions. The first end portion of the rod extends into the resilient tube and has bristles connected thereto. The second end of the rod is connected to the first end of the adaptor and is inserted into the first end of the pen head. The second end of the rod has at least one passage formed therein in order to communicate fluidly the resilient tube and the pen head.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
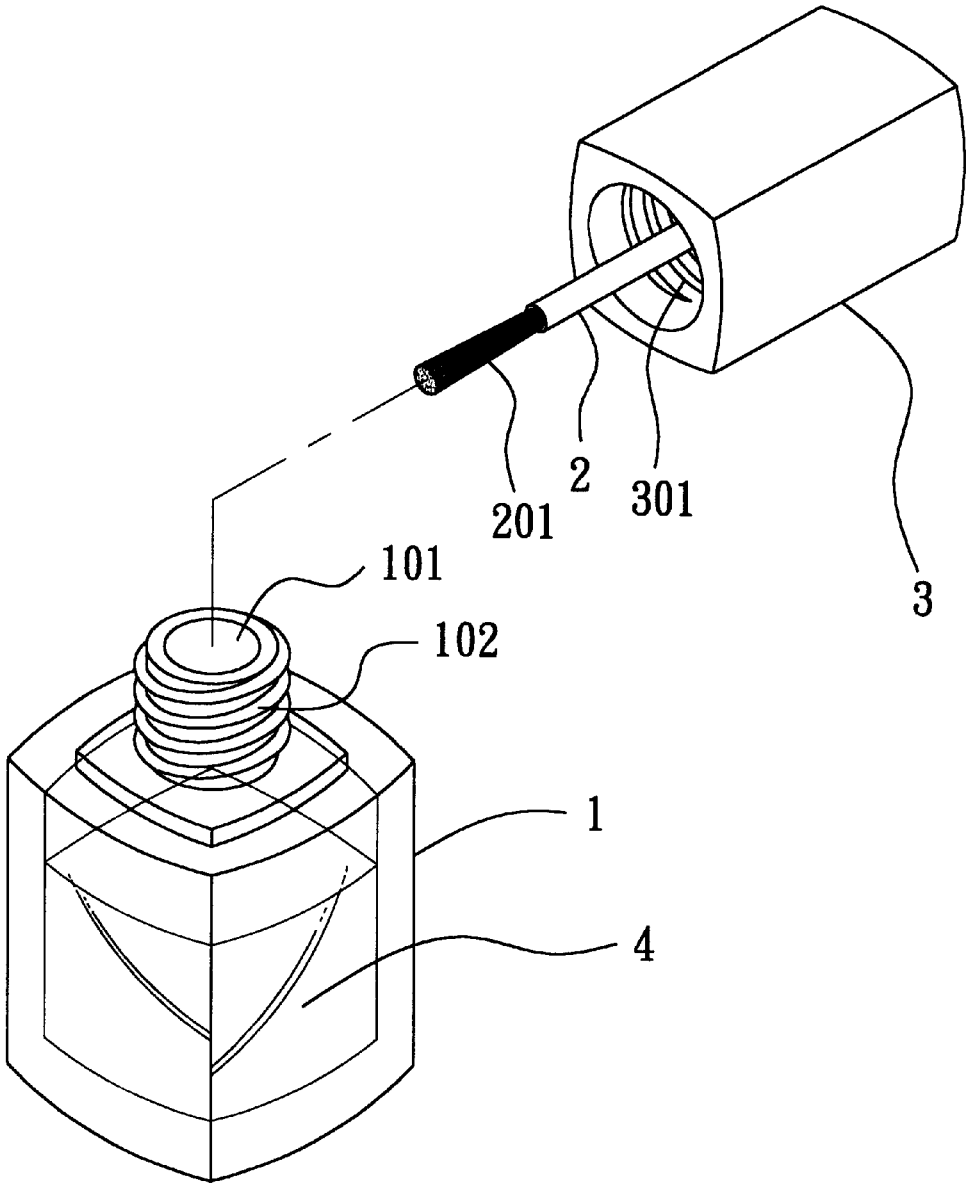
FIG. 1 PRIOR ART
FIG. 1 is an exploded view of a conventional nail enamel applicator.

Before the present invention is disclosed in greater detail, it should be noted that like elements are denoted by the same reference numerals throughout the disclosure.

Figure 2:
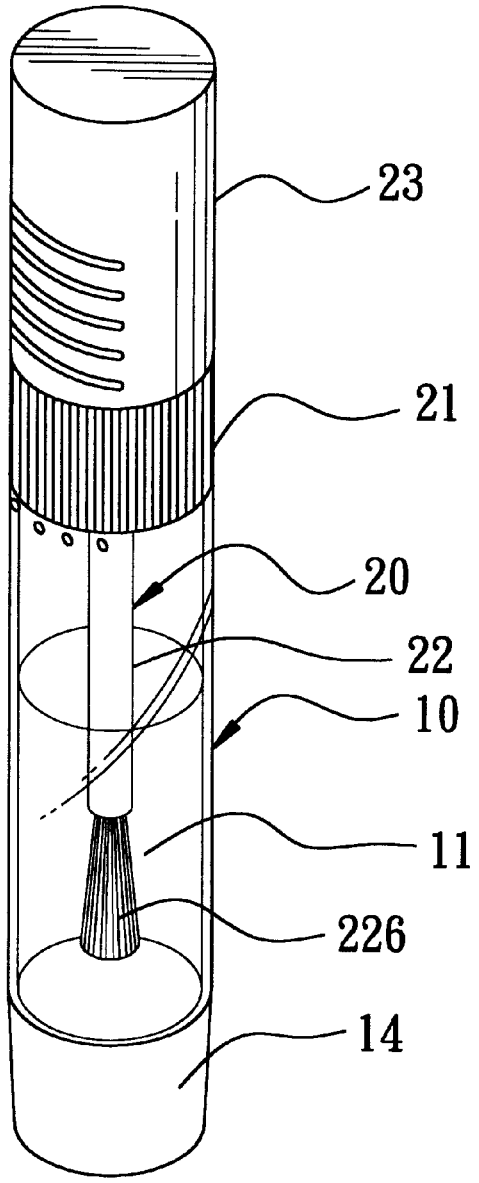
FIG. 2 is a perspective view of a first preferred embodiment of a nail enamel applicator according to the present invention.
Figure 3:
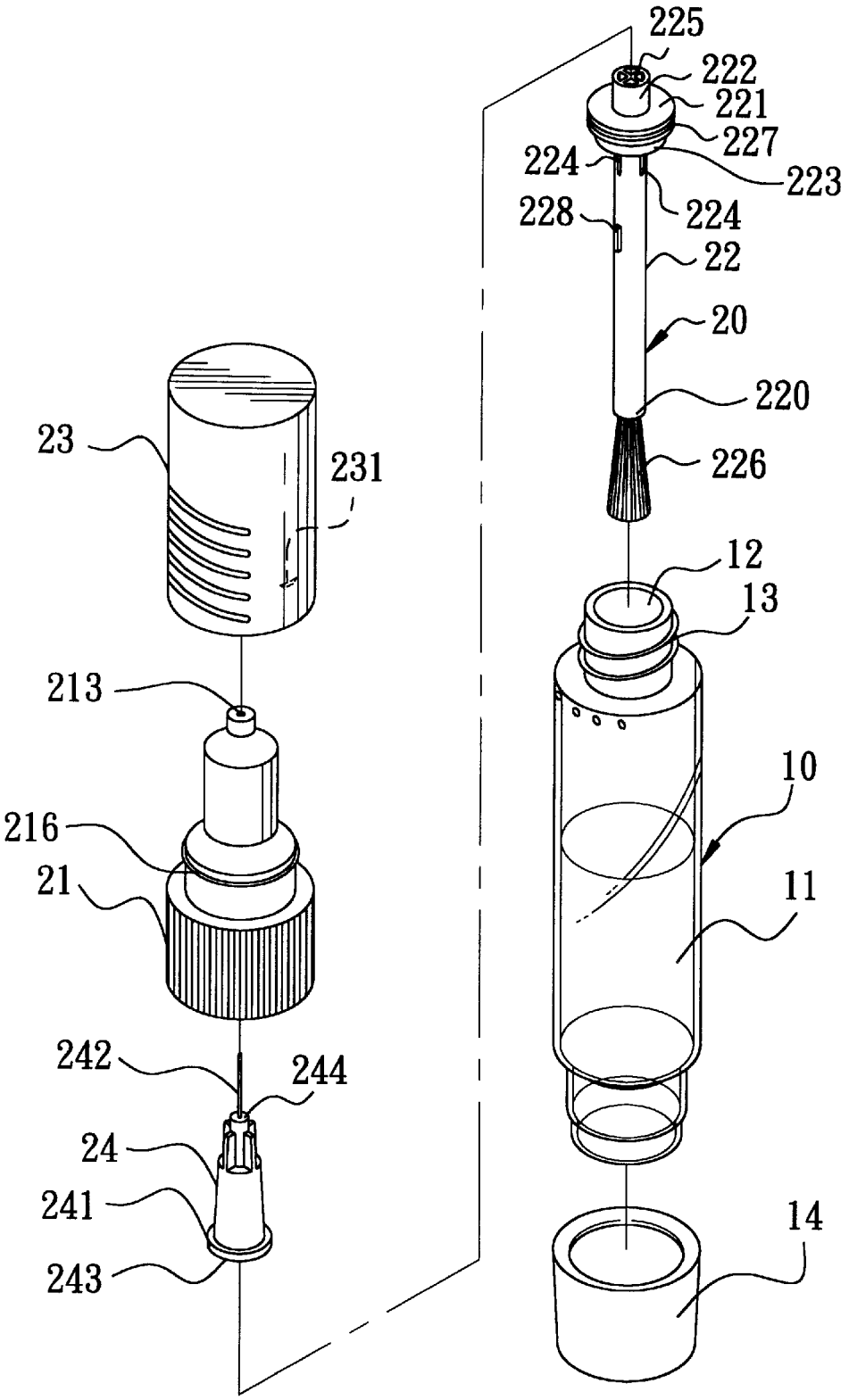
FIG. 3 is an exploded view of the first preferred embodiment of the nail enamel applicator according to the present invention.

Referring to FIGS. 2 and 3, a preferred embodiment of a nail enamel applicator according to the present invention is shown to comprise a resilient tube 10, a hollow adaptor 21, a hollow pen head 24 and a brush member 20.

The resilient tube 10 is made from a soft plastic material and is adapted for receiving nail enamel 11 therein. The resilient tube 10 has an upper open end 12, an external thread 13 formed adjacent to the open end 12, and a decorative cap 14 sleeved onto a closed bottom end of the resilient tube 10.

Figure 4:
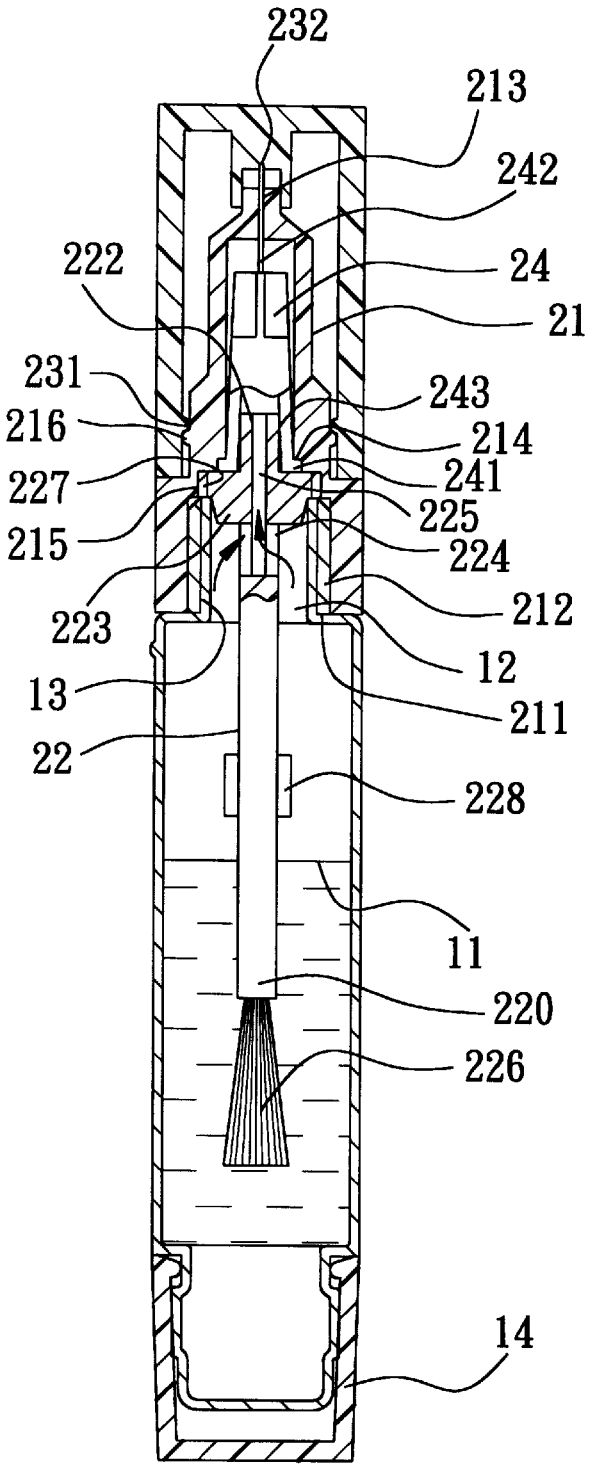
FIG. 4 is a cross-sectional view of the first preferred embodiment of the nail enamel applicator according to the present invention.

Referring to FIGS. 2, 3 and 4, the adaptor 21 has opposed first and second ends 211, 213. The first end 211 has a cross-section that is greater than that of the second end 213. A shoulder portion 214 is formed on an internal wall face adjacent to the first end 211 of the adaptor 21. The internal wall face of the adaptor 21 has a first internal thread 212 near the first end 211 that engages threadedly the external thread 13 of the resilient tube 10 in order to close the open end 12 of the resilient tube 10, and a second internal thread 215 between the shoulder portion 214 and the first internal thread 212 thereof. An annular ridge 216 is formed on an outer wall face of the adaptor 21.

The pen head 24 is received in the adaptor 21 and tapers from an open first end 243 to a second end 244 thereof. A radial flange 241 is formed at the first end 243 of the pen head 24 and is seated on the shoulder portion 214. A hollow tip portion 242 is connected to the second end 244 of the pen head 24 and extends outwardly through the second end 213 of the adaptor 21.

The brush member 20 includes a rod 22 with first and second end portions 220, 222, and a cap member 23 that engages the adaptor 21 to enclose the second end 213 of the adaptor 21. The first end portion 220 of the rod 22 extends into the resilient tube 10 and has bristles 226 connected thereto. The second end portion 222 is inserted into and is connected to the first end 243 of the pen head 24. A ring member 221 is formed adjacent to the second end portion 222 of the rod 22. The ring member 221 has a threaded periphery 227 that engages threadedly the second internal thread 215 of the adaptor 21. The lower face of the ring member 221 has a plug ring 223 that is formed around the rod 22 and that is fitted into and that engages the open end 12 of the resilient tube 10. A plurality of passages 225 are formed in the outer wall face of the rod 22 and are fluidly connected to an opening 225 at the second end portion 222 that opens to the interior of the pen head 24 in order to communicate fluidly the resilient tube 10 and the pen head 24. A pair of opposed projections 228 are formed on an intermediate portion of the rod 22. The cap member 23 has a plurality of protrusions 231 formed on an internal wall face thereof and a socket member 232 protruding from a bottom wall thereof. The protrusions 231 engage the annular ridge 216 to prevent the cap member 23 from disengaging from the adaptor 21. The tip portion 242 of the pen head 24 is inserted into the socket member 232 to close the tip portion 242 when the cap member 23 is connected to the adaptor 21.

In assembly, with reference to FIGS. 3 and 4, the pen head 24 is inserted into the adaptor 21 to permit seating of the radial flange 241 on the shoulder portion 214 of the adaptor 21. The rod 22 then extends into the adaptor 21 and is rotated to permit the threaded periphery 227 to engage threadedly the second internal thread 215. At this time, the second end portion 222 of the rod 22 is inserted snugly in the first end 243 of the pen head 24, while the tip portion 242 extends outwardly through the second end 213 of the adaptor 21. Next, the cap member 23 is mounted on the adaptor 21 to permit the protrusions 231 to engage the annular ridge 216. Finally, the rod 22 extends into the resilient tube 10, and the first internal thread 212 of the adaptor 21 engages threadedly the external thread 13 of the resilient tube 10 to permit the plug ring 223 to fit into the open end 12 of the resilient tube 10. Thus, the open end 12 is closed to prevent the nail enamel 11 from escaping therefrom.

Figure 5:
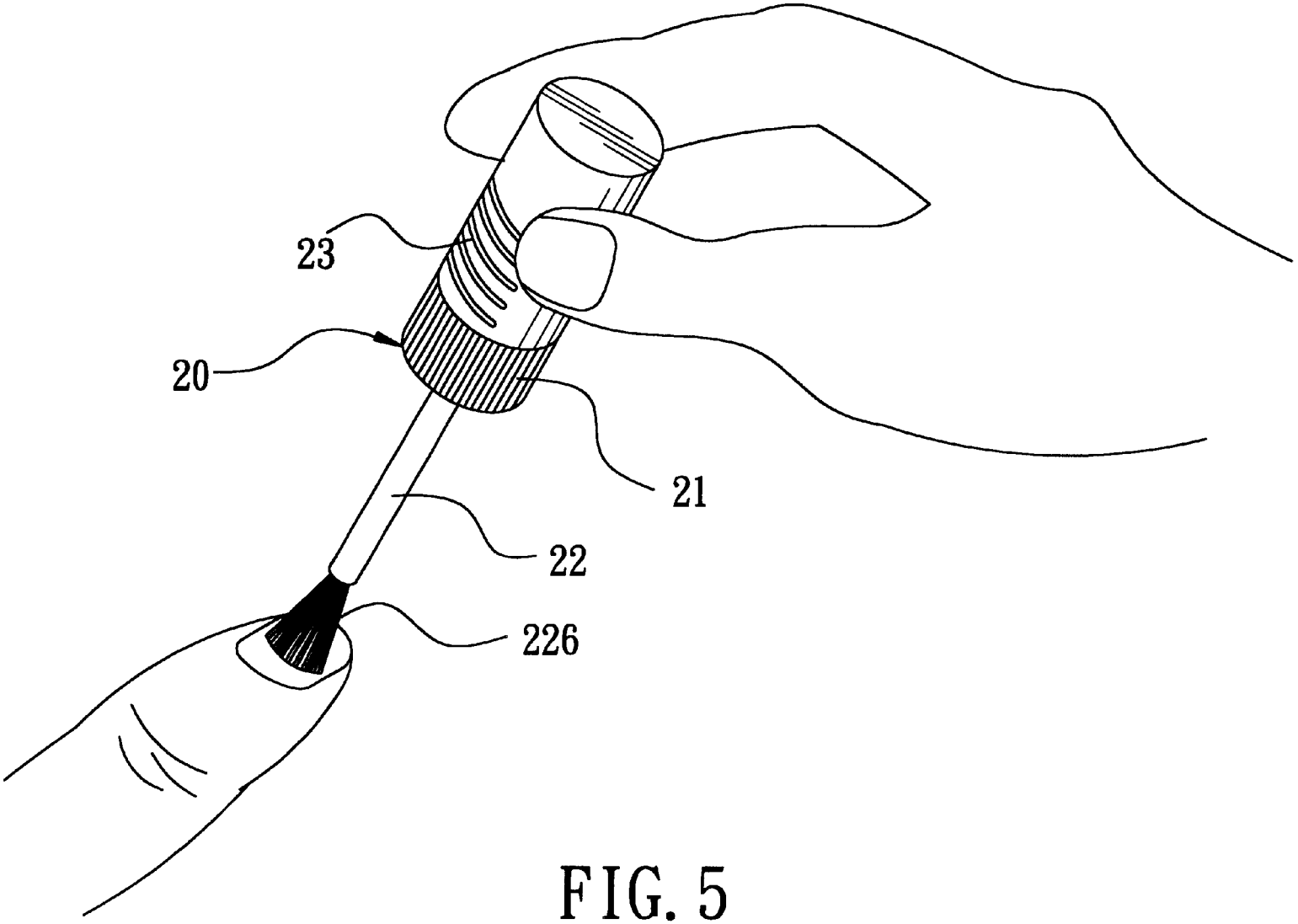
FIG. 5 illustrates how the nail enamel applicator is used to brush a nail.
Figure 6:
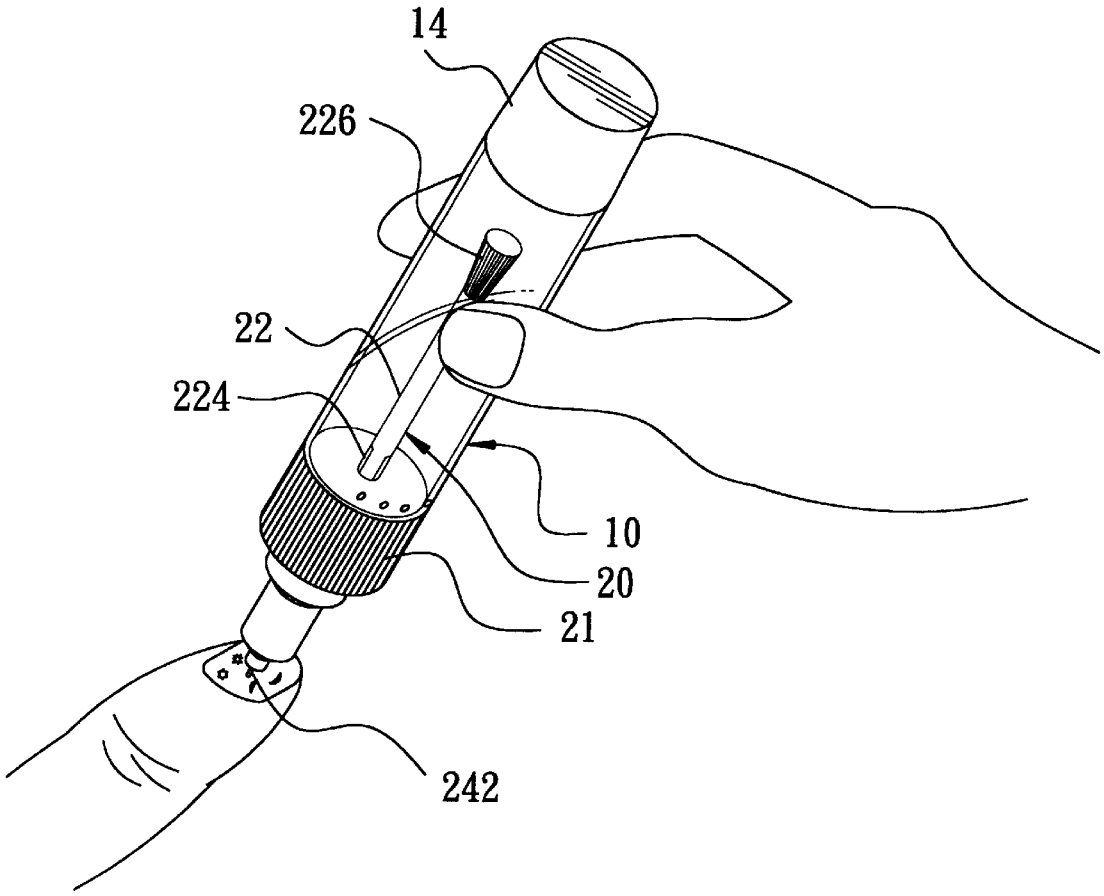
FIG. 6 illustrates how the nail enamel applicator is used to draw a pattern on a nail.

The nail enamel applicator of the present invention can be operated in two ways. First, with reference to FIG. 5, the nail enamel applicator is used to brush a nail of the user. The first internal thread 212 of the adaptor 21 is disengaged from the external thread 13 of the resilient tube 10. The first end portion 220 of the rod 22 extends into the resilient tube 10 to dip the bristles 226 into the nail enamel 11. The nail enamel 11 is then applied onto the nail by holding the cap member 23 and by brushing the bristles 226 onto the nail. When not in use, the first internal thread 212 of the adaptor 21 engages the external thread 13 of the resilient tube 10. Second, with reference to FIG. 6, the nail enamel applicator is used as a pen to draw patterns on the nail. The resilient tube 10 is reversed such that the open end 12 faces downwardly. The cap member 23 is detached from the adaptor 21 by disengaging the protrusions 231 from the annular ridge 216. At this time, the tip portion 242 of the pen head 24 is separated from the socket member 232 of the cap member 23. The tip portion 242 is then pointed at the nail. The resilient tube 10 is squeezed to permit the nail enamel 11 to flow out of the tip portion 242 drop by drop through the passages 224 and the opening 225 in the rod 22 via the pen head 24. When not in use, the cap member 23 is mounted on the adaptor 21 such that the protrusions 231 engage the annular ridge 216.

Figure 7:
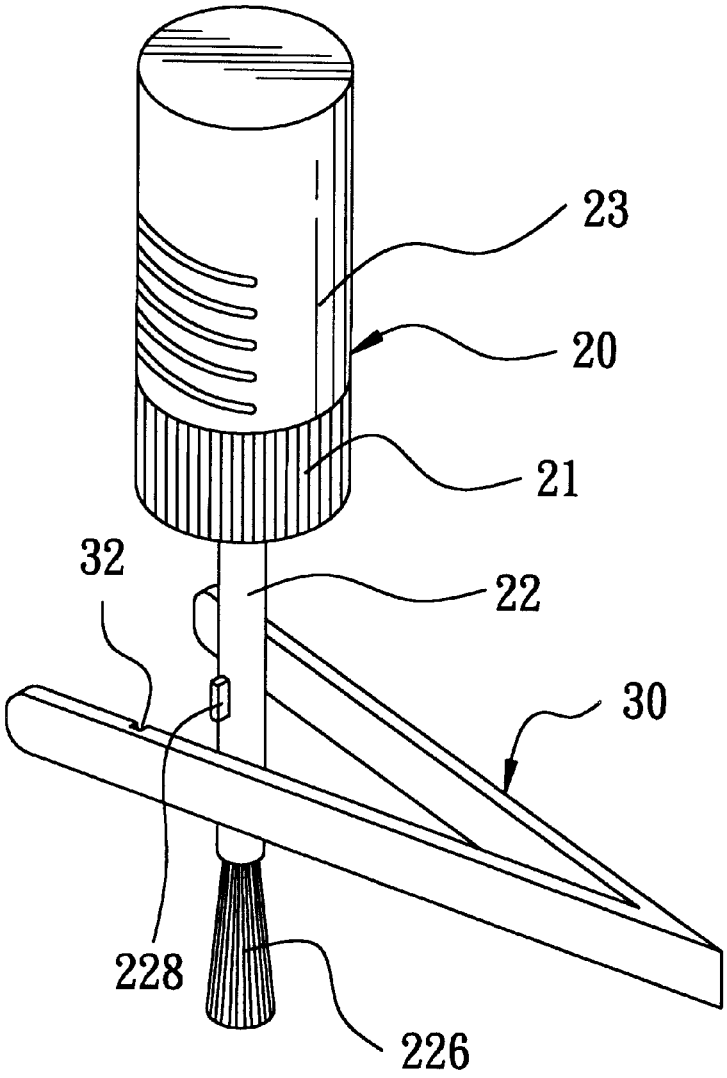
FIG. 7 illustrates how a brush member is removed from a cap member of the nail enamel applicator according to the present invention.

Referring to FIG. 7, when the pen head 23 is blocked or damaged, a clip 30 with two recesses 32 (only one is shown in the figure) is employed to clamp the rod 22 by engaging the recesses 32 and the projections 228 of the rod 22 and to rotate the rod 22 in order to separate the threaded periphery 227 of the ring member 221 on the rod 22 from the second internal thread 215 of the adaptor 21. In this way, the blocked or damaged rod 22 can be replaced with a new one.

Figure 8:
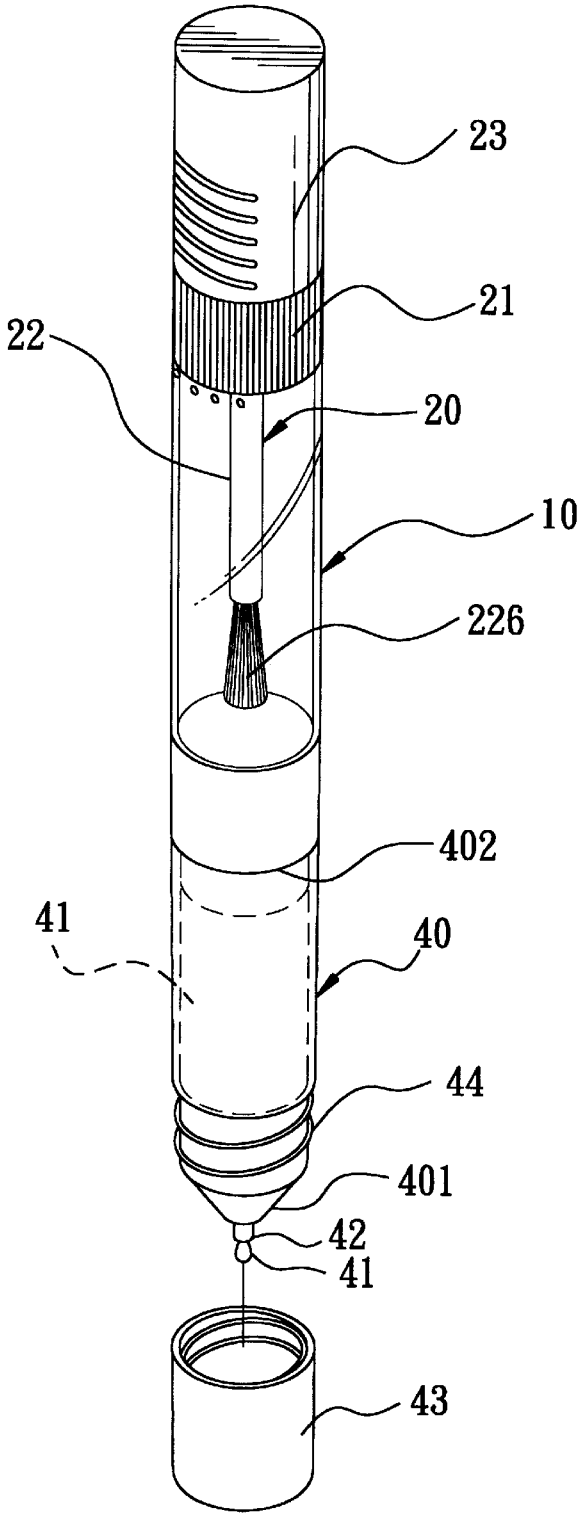
FIG. 8 is a perspective view of a second preferred embodiment of a nail enamel applicator according to the present invention, wherein a second cap member is detached from a second tube of the nail enamel applicator.

Referring to FIG. 8, a second preferred embodiment of a nail enamel applicator according to the present invention is shown to comprise a resilient first tube 10, a brush member 20 and a resilient second tube 40. In this embodiment, the structures of the first tube 10 and the brush member 20 are similar to those of the resilient tube 10 and the brush member 20 of the first preferred embodiment. The second tube 40 is made from a soft plastic material and has a first end 401 and a second end 402 that is connected to the closed end of the first tube 10 in order to receive a polish remover 41 therein. The first end 401 is formed with a liquid outlet 42 and an externally threaded portion 44. The polish remover 41 may flow out of the liquid outlet 42 drop by drop by squeezing the second tube 40. An internally threaded cap 43 engages the externally threaded portion 44 of the second tube 40 in order to close the liquid outlet 42.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A nail enamel applicator, comprising:

a resilient first tube with an open end for receiving nail enamel;

a hollow adaptor having opposed first and second ends, said first end of said adaptor being connected detachably to said open end of said first tube;

a hollow pen head received in said adaptor and having an open first end and a second end with a hollow tip portion that extends outwardly through said second end of said adaptor; and a brush member having a rod with first and second end portions, said first end portion of said rod extending into said first tube and having bristles connected thereto, said second end of said rod being connected to said first end of said adaptor and being inserted into said first end of said pen head, said second end of said rod having at least one passage formed therein in order to communicate fluidly said first tube and said pen head.

2. The nail enamel applicator as claimed in claim 1, further comprising a cap member that engages said adaptor to enclose said second end of said adaptor.

3. The nail enamel applicator as claimed in claim 2, said cap member has an internal wall face and a plurality of protrusions formed on said internal wall face, said adaptor having an outer wall face and an annular ridge formed on said outer wall face, said protrusions engaging said annular ridge to prevent said cap member from disengaging from said adaptor.

4. The nail enamel applicator as claimed in claim 1, wherein said adaptor further has a first internal thread formed adjacent to said first end thereof, said first tube having an external thread that is formed adjacent to said open end of said first tube and that engages threadedly said first internal thread of said adaptor.

5. The nail enamel applicator as claimed in claim 4, wherein said adaptor has an internal wall face, a shoulder portion formed on said internal wall face adjacent to said first end of said adaptor, and a second internal thread formed on said internal wall face between said shoulder portion and said first internal thread thereof, said pen head having a radial flange that is formed adjacent to said first end thereof and that is seated on said shoulder portion of said adaptor, said rod having a ring member formed adjacent to said second end portion thereof, said ring member having a threaded periphery that engages threadedly said second internal thread of said adaptor.

6. The nail enamel applicator as claimed in claim 1, wherein said first tube further has a closed end opposed to said open end thereof, said nail enamel applicator further comprising a resilient second tube having one end connected to said closed end of said first tube and the other end formed with a liquid outlet and an externally threaded portion, said nail enamel applicator further comprising an internally threaded cap engaging said externally threaded portion of said second tube.

* * * * *